US007316037B2

(12) United States Patent
Wilkinson

(10) Patent No.: US 7,316,037 B2
(45) Date of Patent: Jan. 8, 2008

(54) SEAT LIFTER

(76) Inventor: Jerry Lee Wilkinson, 1134 Big Sky Dr., Fenton, MO (US) 63026

( * ) Notice: Subject to any disclaimer, the term of this patent is extended or adjusted under 35 U.S.C. 154(b) by 0 days.

(21) Appl. No.: 11/320,297

(22) Filed: Dec. 29, 2005

(65) Prior Publication Data

US 2007/0151007 A1 Jul. 5, 2007

(51) Int. Cl.
*A47K 13/10* (2006.01)

(52) U.S. Cl. ..... 4/246.1; 4/246.5; 4/246.4

(58) Field of Classification Search ..... 4/246.1–246.5, 4/237, 241

See application file for complete search history.

(56) References Cited

U.S. PATENT DOCUMENTS 2,632,896 A * 3/1953 Morikawa ..... 4/246.1
3,303,517 A * 2/1967 Wood et al. ..... 4/246.4
5,177,818 A * 1/1993 Tsai ..... 4/241
6,081,936 A * 7/2000 Bargman et al. ..... 4/246.1

* cited by examiner

*Primary Examiner*—Khoa D. Huynh

(57) ABSTRACT

The seat lifter is for lifting a toilet seat. The seat lifter includes a foot pedal, cables, pulleys, a base, spring hinge, lifting arm, cable blocks, and a counter weight. The hinge holds the base down on to the toilet with its mounting hardware. The whole mechanism is held to the toilet by the toilet seat mounting holes in the toilet bowl. The seat is always in the down position until the foot pedal is depressed. Once the foot pedal is depressed a cable is pulled against the cable block then a small diameter pulley is rotated on a shaft that is pinned to a larger diameter pulley (this pulley assembly is called a reduction spool because it takes a small movement of the foot pedal to make a large enough movement to raise the seat to the proper height). The larger pulley then pulls a longer cable, that pulls a cable block mounted to a lifting arm with a counter weight, which pulls the arm down, that in turn moves a spring hinge attached to the seat. The seat is now in the lifted position. To return the seat to the down position simply release the pedal.

1 Claim, 5 Drawing Sheets

22
5
2
21
6
19
20
23

20
5
24
23
6
2

SEAT LIFTER

BACKGROUND OF INVENTION

The device invented is to lift the toilet seat with hands free operation. This is achieved by using foot power. The device includes a foot pedal, cables, reduction spool, lifting arm, spring hinge, base, cable block and counter weight. To operate this device all you have to do is step on the pedal which will pull a short cable, which will rotate the reduction spool, to pull a longer cable, which will pull a lifting arm with a adjustable counter weight attached (to counter balance the seat), this will rotate the spring hinge, the spring is to help lift the seat and to help in lowering the seat. When you are done simply take your foot off the pedal and the seat will come down on its own, when not in use it is always in the down position. The device is mounted to the toilet where a standard toilet seat is normally bolted. The adjustable counter weight can be moved up and down the lifting arm to accommodate different weight seats. A small child can lift the seat easily when counter balanced properly.

The prior art was to manually lift the seat with your hands. This is very unsanitary, and some persons would forget to put the seat down when leaving, which doesn't help the male, female relationship at all. This seat would work great in public rest rooms where hands free operation is a must, especially in the restaurant business. It would also be very helpful in hospitals, where patients can not bend down to lift the seat, and of course for health reasons. There are other toilet seat lifters that have been patented few if any are in the market place so far. One would guess that the reason for that is there are too many parts, too hard to clean, have to have the right style toilet, have to mount to floor or wall or they are electric (water and electricity don't mix) and how many times do you see a wall outlet next to a toilet? A battery powered model would require regular battery replacement. There are also hydraulic cylinder type seat lifters where the cylinder is in the toilet tank, not all toilets will be able to accommodate this type of mechanism, and the hardware in the tank would have to be replaced for this system.

Figure 1:
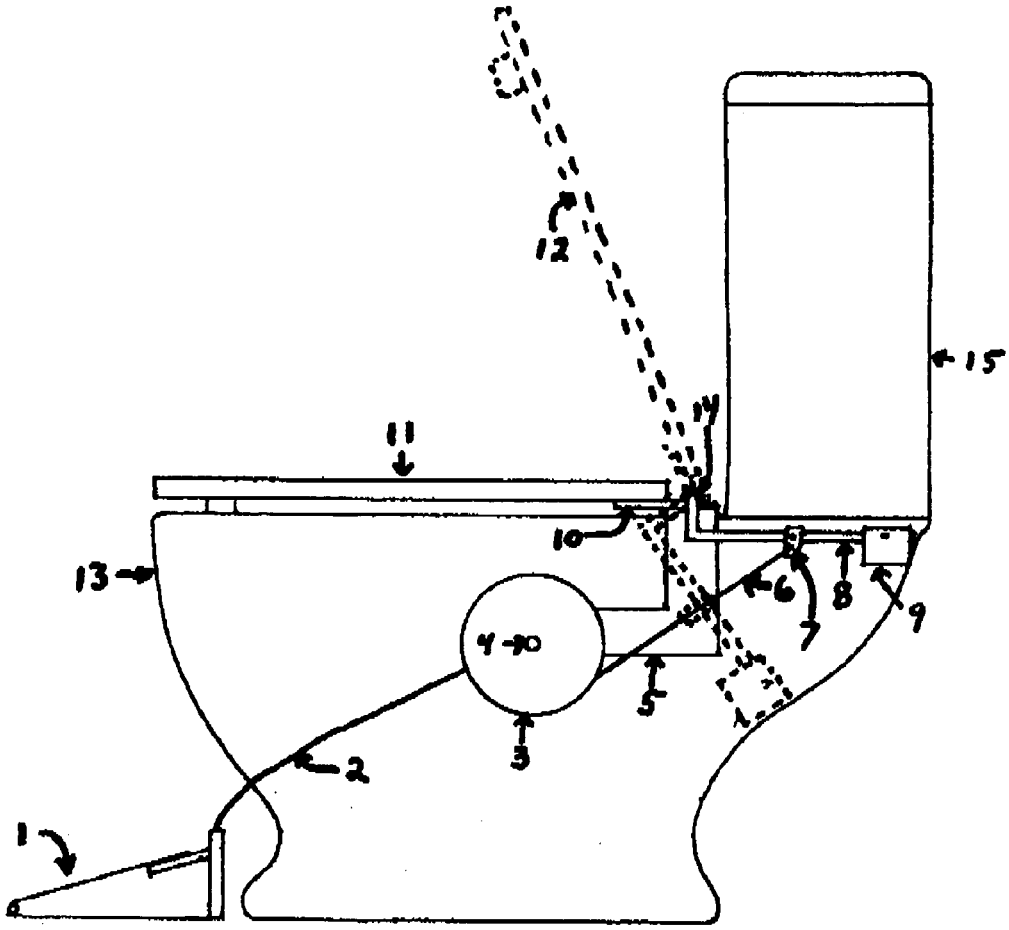

FIG. 1 This is a side view of a toilet with the seat lifter mounted in place with the seat in the down position, the dashed lines represent the seat in the up position.

Figure 2:
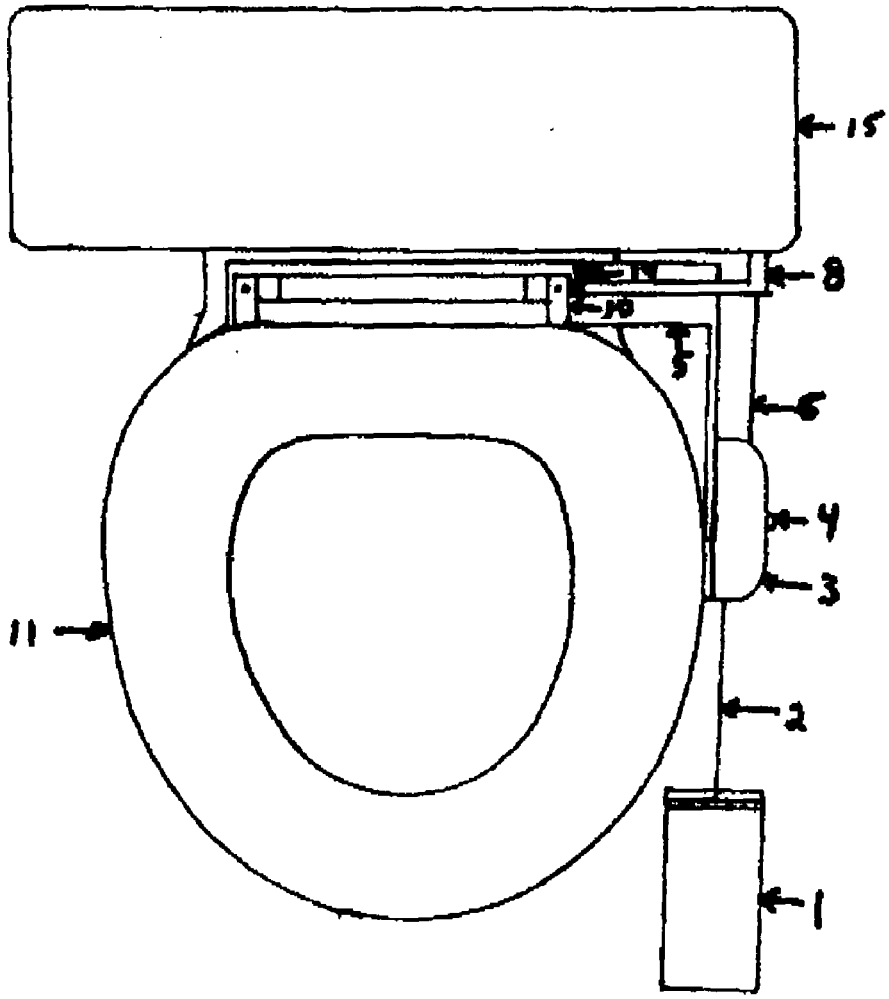

FIG. 2 This is the top view of a toilet with the seat lifter mounted in place with the seat attached, the seat is in the down position.

Figure 3:
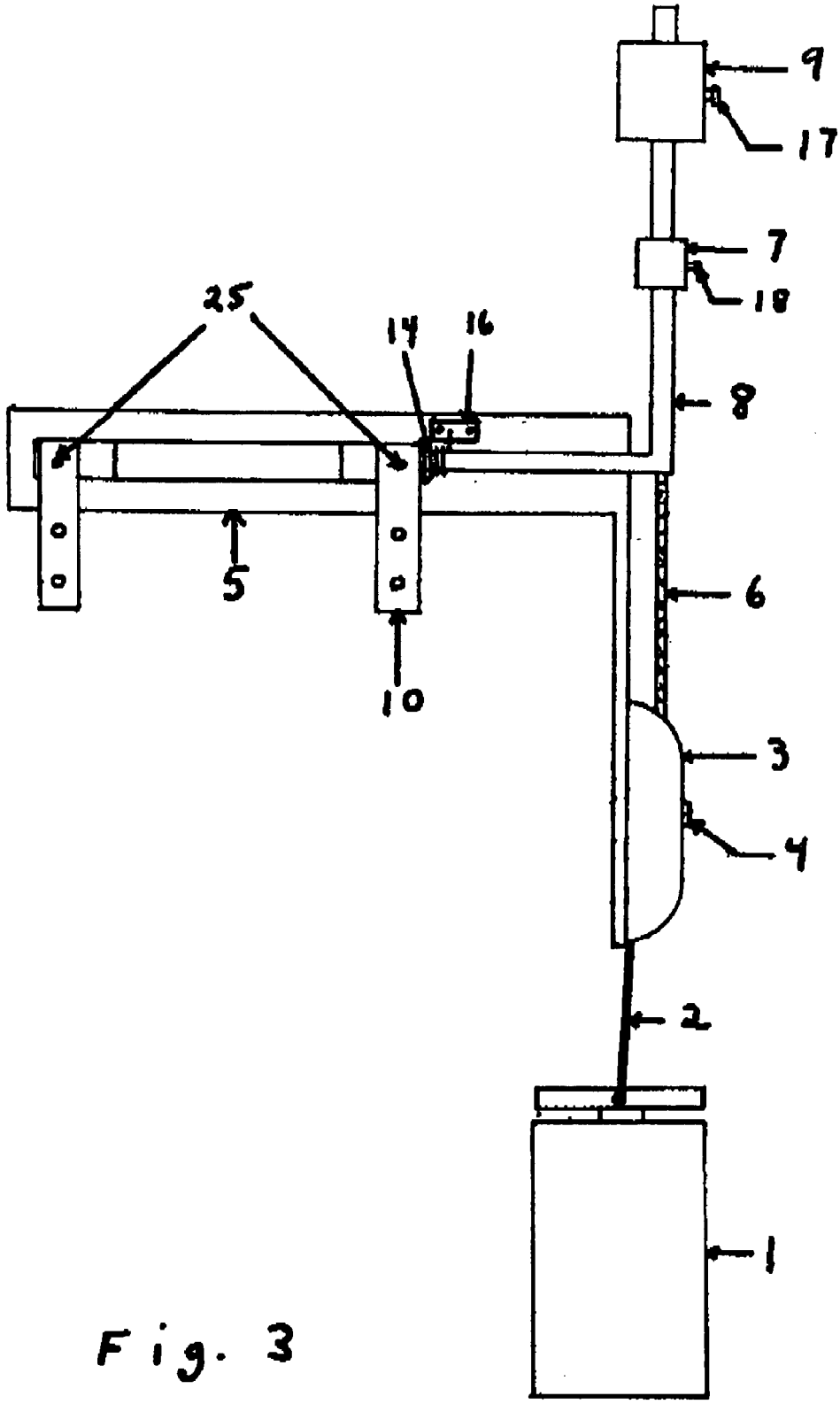

FIG. 3 This is the top view of the seat lifter without the toilet and the seat, it shows the lifter in the down position.

Figure 4:
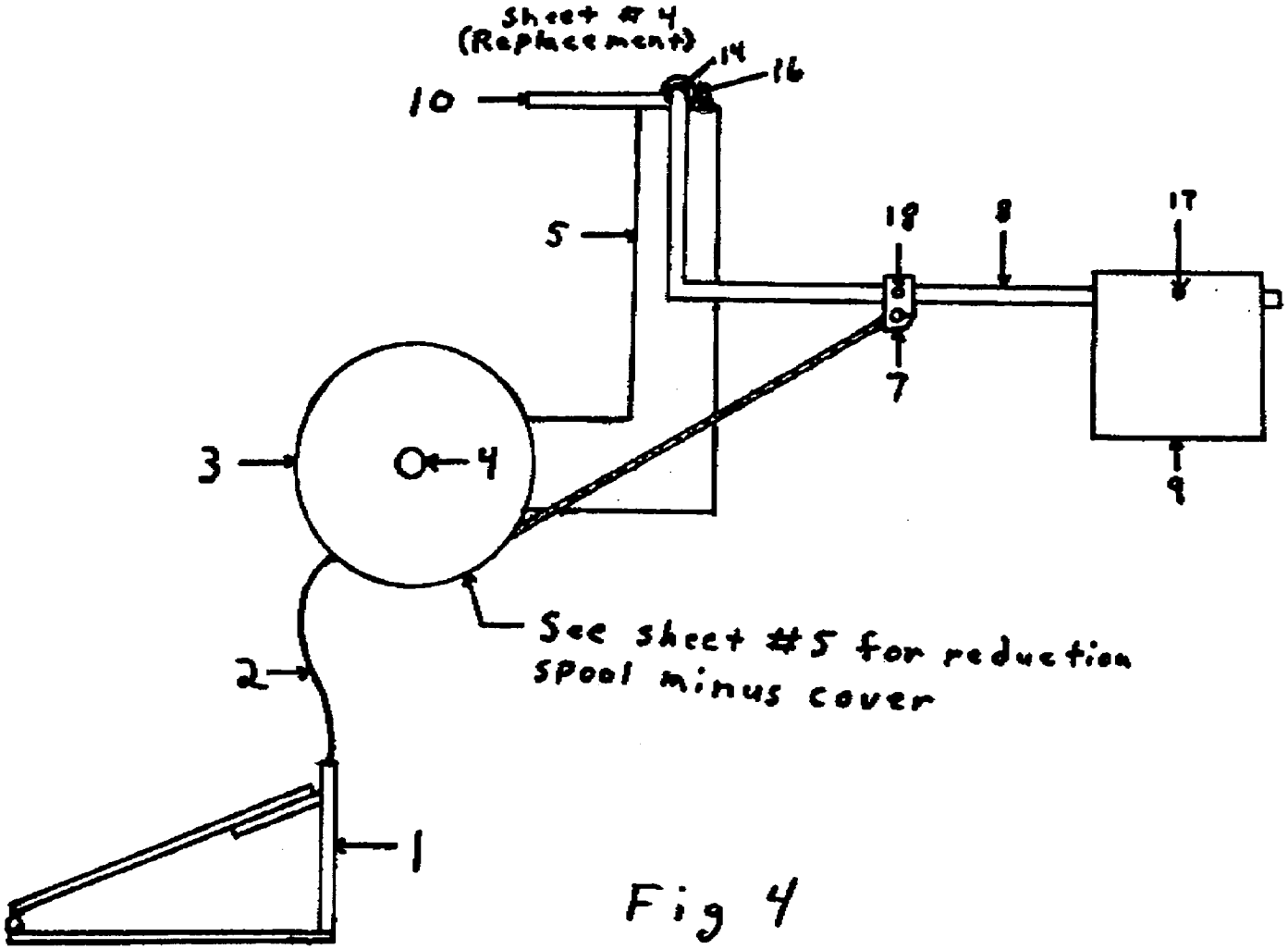

FIG. 4 This is the side view of the seat lifter without the toilet and the seat, it shows the lifter in the down position.

Figure 5:
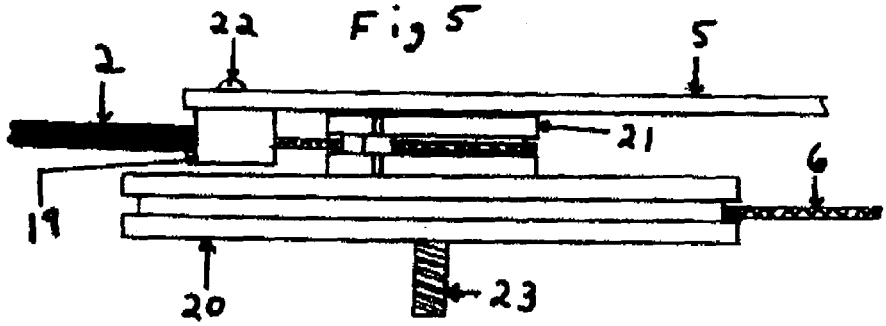
Figure 6:
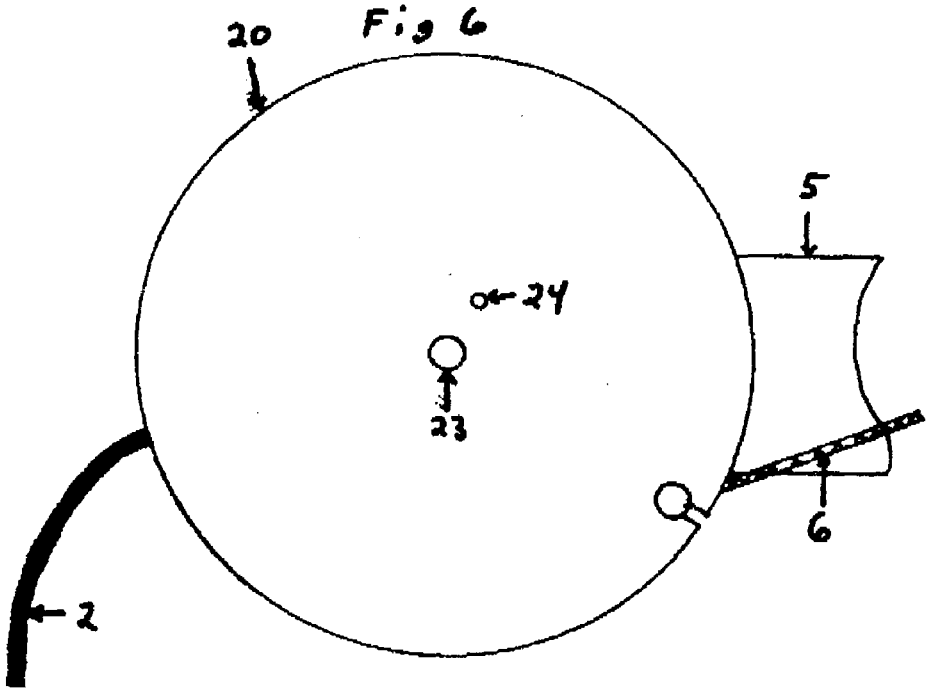

FIGS. 5 and 6 This view is of the reduction spool assembly minus the cover, FIG. 5 is the top view of the pulleys and cables. FIG. 6 is the side view of the pulley and cables.

Referring to the drawings there is a toilet bowl #13, with a tank # 15, with a seat #11, attached to a hinge # 10, the base plate # 5 is sandwiched between the toilet and hinge # 10 which is mounted to the toilet were the toilet seat is normally mounted by conventional hardware, a spring # 14 is attached to the hinge # 10 this helps lift the seat and keeps the seat from slamming down, the lifting arm # 8 serves as the hinge pin for hinge # 10, roll pins # 25 go through hinge # 10 and lifting arm # 8 keeping them in time, spring # 14 fits over lifting arm # 8, bracket # 16 is attached to base # 5 and is used to put tension on spring # 14. Cable block # 7 with adjusting screw # 18 can be slid on lifting arm #8 to adjust how high you want the seat to lift up, counter weight # 9 with adjusting screw # 17 can be slid on arm #8 to adjust for the weight of seat # 11. Shaft # 23 is welded to base # 5, pulley # 20 and #21 rotate on shaft # 23, roll pin # 24 goes through pulleys # 20 and # 21 to keep them timed properly, cable block # 19 is attached by screw # 22 to base # 5, cable #2 is attached to pulley # 21 and slides through cable block # 19, the other end of cable # 2 is attached to foot pedal # 1. Cable # 6 is attached the pulley # 20, the other end of cable # 6 is attached to cable block # 7, cover # 3 covers pulleys # 20, # 21 and cable block # 19 it is attached by nut # 4 screwed on shaft # 23.

Now it is time to lift the seat with the seat lifter invention, the user stands in front of the toilet as he usually would, he steps down on foot pedal # 1, which pulls cable #2 which pulls pulley # 21 that pulls pulley # 20(they both rotate on shaft # 23) that pulls cable # 6, which pulls cable block # 7, that pulls down lifting arm # 8, hinge #10 lifts up and spring # 14 releases tension as hinge raises up. When foot pedal # 1 is fully depressed then the seat is all the way up simply keep standing on the pedal until finished and then release the pedal and the sequence stated above will reverse and the seat will go back to the down position. The seat can be manually lifted up if need be, the mechanism will not be affected. The seat lifter is made of metal with the exception of a plastic cover covering the pulleys of the reduction spool. It is possible that certain parts could be made out of plastic such as but not exclusive of the pulleys and the foot pedal.

I claim:

1. A toilet seat-lifting device for use with a toilet assembly having toilet bowl (13), a water tank (15), a toilet seat (11) pivotally attached to the toilet bowl via a hinge (10), the device comprises:

- a base plate (5) having a first end adapted to be sandwiched between an upper surface of the toilet bowl and the hinge by conventional hardware, and a second end;
- a spring (14) attachable to the hinge (10) to help lift the toilet seat and keep the toilet seat from slamming down;
- a lifting arm (8) serves as the hinge pin for the hinge (10), wherein said spring fits over said lifting arm;
- a plurality of roll pins (25) adapted to pass through the hinge and said lifting arm to keep them in time;
- a bracket (16) is attached to the base plate and is used to put tension on said spring;
- a first cable block (7) with a first adjusting screw (18) slidably mounted on said lifting arm to adjust the high in which the seat to be lifted up;
- a counter weight (9) with a second adjusting screw (17) slidably mounted on an end of said lifting arm (8) to adjust for the weight of the toilet seat;
- a shaft (23) attached to said second end of said base plate;
- a large diameter pulley (20) and a small diameter pulley (21) rotate on said shaft;
- a rollpin (24) passes through said large diameter pulley and said small diameter pulley to keep them timed properly;
- a second cable block (19) is attached by a screw (22) to said base plate;

a first cable (2) having one end slides through said second cable block and attached said small diameter pulley, and another end of said first cable attached to a foot pedal (1);

a second cable (6) having one end attached to said large diameter pulley, and another end of said second cable attached to said first cable block; and a cover (3) for covering said pulleys and said second cable block via a nut (4) screwed onto said shaft, wherein a downward pressure applied onto said foot pedal actuates said first cable, said pulleys and said second cable, said second cable pulls down said lifting arm, the movement of said lifting arm causes the hinge to lift up, as the hinge raises up said spring releases tension and the toilet seat is lifted up.

* * * * *